US008781655B2

(12) United States Patent
Landes et al.

(10) Patent No.: US 8,781,655 B2
(45) Date of Patent: Jul. 15, 2014

(54) AUTOMATED TRACK SURVEYING AND BALLAST REPLACEMENT

(71) Applicants: Nathan A. Landes, St. Joseph, MO (US); Ivan E. Bounds, St. Joseph, MO (US)

(72) Inventors: Nathan A. Landes, St. Joseph, MO (US); Ivan E. Bounds, St. Joseph, MO (US)

(73) Assignee: Herzog Railroad Services, Inc., St. Joseph, MO (US)

( * ) Notice: Subject to any disclaimer, the term of this patent is extended or adjusted under 35 U.S.C. 154(b) by 0 days.

(21) Appl. No.: 13/654,126

(22) Filed: Oct. 17, 2012

(65) Prior Publication Data

US 2013/0096739 A1 Apr. 18, 2013

Related U.S. Application Data

(60) Provisional application No. 61/548,429, filed on Oct. 18, 2011.

(51) Int. Cl.
*G06F 17/00* (2006.01)

(52) U.S. Cl.
USPC ..... 701/19

(58) Field of Classification Search
USPC ..... 701/19
See application file for complete search history.

(56) References Cited

U.S. PATENT DOCUMENTS

| | | | |
|---|---|---|---|
| 4,065,856 | A | 1/1978 | Waters |
| 4,338,031 | A | 7/1982 | Miller et al. |
| 4,700,223 | A | 10/1987 | Shoutaro et al. |
| 5,243,918 | A | 9/1993 | Bounds |
| 5,284,097 | A | 2/1994 | Peppin et al. |
| 5,289,780 | A | 3/1994 | Bounds |
| 5,311,822 | A | 5/1994 | Bounds |
| 5,331,745 | A | 7/1994 | Jager |

(Continued)

FOREIGN PATENT DOCUMENTS

| | | |
|---|---|---|
| EP | 1418273 B1 | 11/2005 |
| FR | 2867491 | 9/2005 |
| FR | 2890086 | 3/2007 |
| FR | 2913392 | 3/2007 |

OTHER PUBLICATIONS

International Application No. PCT/US 12/60786, PCT Notification of Transmittal of the International Search Report and the Written Opinion of the International Searching Authority, or the Declaration, mailed Jan. 7, 2013.

(Continued)

*Primary Examiner* — Mary Cheung
*Assistant Examiner* — Anne Mazzara
(74) *Attorney, Agent, or Firm* — Erickson, Kernell, Derusseau & Kleypass, LLC

(57) ABSTRACT

A method of surveying a section of a railway to determine amounts of ballast to be replaced keyed to position coordinates of track locations includes moving a survey vehicle along the railway, optically scanning the track at selected intervals to obtain optical data points with associated position coordinates, recording images at the intervals with position coordinates, recording position coordinates of no-spread zones, processing the optical data points to derive ballast unit weights associated with locations along the track, detecting anomalous unit weights, accessing images associated with the locations of the anomalous unit weights, accessing the anomalous unit weights to adjust as necessary, and loading the adjusted data into a computer of a ballast train to control the application of replacement ballast along the track according to the detected position of the ballast train.

20 Claims, 5 Drawing Sheets

(56) References Cited

U.S. PATENT DOCUMENTS

| | | | | |
|---|---|---|---|---|
| 5,361,704 | A | 11/1994 | Bounds | |
| 5,423,268 | A | 6/1995 | Bounds | |
| 5,605,099 | A | 2/1997 | Sroka et al. | |
| 5,657,700 | A | 8/1997 | Bounds | |
| 5,721,685 | A | 2/1998 | Holland et al. | |
| RE36,685 | E | 5/2000 | Bounds | |
| 6,058,628 | A | 5/2000 | Theurer et al. | |
| 6,128,558 | A | 10/2000 | Kernwein | |
| 6,161,986 | A | 12/2000 | Smith et al. | |
| 6,356,299 | B1 | 3/2002 | Trosino et al. | |
| 6,526,339 | B1 | 2/2003 | Herzog et al. | |
| 6,647,891 | B2 | 11/2003 | Holmes et al. | |
| 6,704,626 | B1 | 3/2004 | Herzog et al. | |
| 6,758,147 | B2 | 7/2004 | Howard et al. | |
| 6,768,551 | B2 * | 7/2004 | Mian et al. | 356/446 |
| 6,804,621 | B1 | 10/2004 | Pedanckar | |
| 6,976,324 | B2 | 12/2005 | Theurer et al. | |
| 6,981,452 | B2 | 1/2006 | Herzog et al. | |
| 7,050,926 | B2 | 5/2006 | Theurer et al. | |
| 7,152,347 | B2 | 12/2006 | Herzog et al. | |
| 7,428,453 | B2 | 9/2008 | Davenport et al. | |
| 7,437,997 | B2 | 10/2008 | Herzog et al. | |
| 7,469,479 | B2 | 12/2008 | Jager | |
| 7,562,563 | B2 | 7/2009 | Wee | |
| 7,616,329 | B2 | 11/2009 | Villar et al. | |
| 7,707,943 | B2 | 5/2010 | Herzog et al. | |
| 7,707,944 | B2 | 5/2010 | Bounds | |
| 7,714,886 | B2 * | 5/2010 | Kilian et al. | 348/135 |
| 7,755,774 | B2 | 7/2010 | Farritor et al. | |
| 7,765,935 | B2 | 8/2010 | Bounds | |
| 7,920,984 | B2 | 4/2011 | Farritor | |
| 7,969,558 | B2 | 6/2011 | Hall | |
| 8,081,320 | B2 | 12/2011 | Villar et al. | |
| 8,181,577 | B2 | 5/2012 | Bounds | |
| 2002/0073882 | A1 | 6/2002 | Howard et al. | |
| 2005/0278982 | A1 | 12/2005 | Herzog et al. | |
| 2007/0024468 | A1 | 2/2007 | Quandel et al. | |
| 2008/0141893 | A1 | 6/2008 | Herzog et al. | |
| 2009/0037039 | A1 | 2/2009 | Yu et al. | |
| 2009/0273788 | A1 | 11/2009 | Nagle, II | |
| 2010/0004804 | A1 | 1/2010 | Anderson et al. | |
| 2010/0107925 | A1 | 5/2010 | Bounds | |
| 2012/0192756 | A1 | 8/2012 | Miller et al. | |

OTHER PUBLICATIONS

International Application No. PCT/US 12/60786, PCT Written Opinion of the International Searching Authority, mailed Jan. 7, 2013.
International Application No. PCT/US 12/60786, PCT International Search Report, mailed Jan. 7, 2013.

* cited by examiner

| 102 Index | 104 Side | 106 Tonnage | 108 Latitude | 110 Longitude | 112 Altitude |
|---|---|---|---|---|---|
| 427 | Right | 3548 tons | 41.XX98 | −90.XX57 | 143.0412 |
| 581 | Right | 1363 tons | 41.XX202 | −90.XX34 | 144.7747 |
| 581 | Left | 2443 tons | 41.XX202 | −90.XX34 | 144.7747 |
| 582 | Right | 2091 tons | 41.XX189 | −90.XX33 | 144.9405 |
| 582 | Left | 4523 tons | 41.XX189 | −90.XX33 | 144.9405 |
| 583 | Right | 2957 tons | 41.XX175 | −90.XX33 | 145.0393 |

100

AUTOMATED TRACK SURVEYING AND BALLAST REPLACEMENT

CROSS-REFERENCE TO RELATED APPLICATION

This application claims priority from U.S. Provisional Application Ser. No. 61/548,429 filed Oct. 18, 2011 for LIDAR BASED AUTOMATED TRACK SURVEYING AND BALLAST REPLACEMENT SYSTEM, the disclosure of which is incorporated herein by reference.

BACKGROUND OF THE INVENTION

1. Field of the Invention

This invention relates generally to railroad maintenance and, more particularly, to methods of surveying railroad track beds in conjunction with position recording and performing track maintenance operations, such as ballast replacement, based on the survey results.

2. Background & Description of the Related Art

Conventional railroads in the United States and elsewhere are formed by a compacted sub-grade, a bed of gravel ballast, wooden cross-ties positioned upon and within the ballast, and parallel steel rails secured to the ties. Variations of construction occur at road and bridge crossings, at switch points, and in other circumstances. The ballast beneath and between the ties stabilizes the positions of the ties, keeps the rails level, and provides some cushioning of the composite structure for loads imposed by rail traffic. Vibrations from the movement of tracked vehicles over the rails and weathering from wind, rain, ice, and freeze and thaw cycles can all contribute to dislodging of some of the ballast over time. Thus, in addition to other maintenance activities, it is necessary to replace ballast periodically to maintain the integrity and safety of railroads.

Ballast is usually spread using specially configured ballast hopper cars which include a hopper structure holding a quantity of ballast, a ballast chute communicating with the hopper, and a motorized ballast discharge door in the chute. The door can be controlled to selectively open or close to control the discharge of ballast. In some designs, the discharge door can be controlled to open outboard toward the outside of the rails, to close, or to open inboard toward the inside between the rails. In other configurations, a center door and outer doors may be provided for each hopper. Typical ballast hopper cars have a front hopper and a rear hopper, and each hopper has two transversely spaced doors, one to the left and one to the right. Thus, each hopper door can be controlled to discharge ballast outside the rails on the left and/or the right or between the rails. A typical configuration of a ballast hopper car is described in more detail in U.S. Pat. No. 5,657,700, which is incorporated herein by reference.

In general, ballast spreading has been controlled manually in cooperation with spotters who walk alongside the moving ballast cars to open or close the ballast doors as necessary. A more recent ballast spreading control technique is by the use of a radio linked controller carried by an operator who walks alongside the moving ballast cars. Both conventional control methods are so slow as to disrupt normal traffic on the railroad section being maintained, thereby causing delays in deliveries and loss of income. Because railroad companies typically maintain hundreds or thousands of miles of track on a recurring schedule, the ballast replacement component of track maintenance alone can be a major undertaking in terms of equipment, materials, traffic control, labor, and management. In the past, estimations of the amount of ballast to be spread along tracks were based on inspection and experience. More recently, automated systems for scanning a track bed and determining amounts of ballast to be replaced have been developed, such as described in U.S. Pat. No. 6,976,324, which is incorporated herein by reference. Methods for spreading railroad ballast with location control based on data received from the global navigation satellite system (GNSS), also commonly known as the global positioning system or GPS, are disclosed in U.S. Pat. Nos. 6,526,339 and 7,152,347, which are incorporated herein by reference.

SUMMARY OF THE INVENTION

The present invention provides embodiments of a method for surveying a section of a railway to determine amounts of ballast to be replaced keyed to position coordinates of track locations. A survey vehicle is moved along the railway as a position coordinate system determines position coordinates of the vehicle and enters them into a survey computer system. As the survey vehicle moves along the railway, an optical scanning system scans the track at regular intervals to gather optical track profile data points which are stored in the survey computer along with position coordinates and time stamps. At the same time, photographic images are recorded along with position coordinates and stored in the survey computer. While these operations are occurring, end points of no-spread areas which are not to have ballast spread thereon are entered into the survey computer.

The track profile data points are subsequently processed to derive localized ballast profiles which are compared to ballast templates. Area differences are accumulated along designated units of length of the railway to determine unit volumes of ballast to be replaced. The unit volumes can then be converted to unit weights of ballast which are to be dispersed along corresponding units of the railway section. Access to the unit weights is provided to enable analysis thereof by a computer, by an analyst, or both to determine if the unit weights appear to be appropriate and to detect any anomalies in the unit weights. If such anomalous unit weights are detected, access to images of the track units corresponding to the anomalous unit weights is provided to enable review of the images to determine the possible reason for the anomalous unit weights. If necessary, the anomalous unit weights can be accessed and adjusted to more appropriate amounts. Once the unit weights have been adjusted, as necessary, the unit weights and position coordinates may then be entered to a ballast train computer or head end controller to control the distribution of ballast from ballast cars of the train during a ballast distribution run. Afterwards, the deposited ballast can be tamped or otherwise dressed to achieve the desired ballast profile.

The survey vehicle may, for example, be a road vehicle such as a pick-up truck equipped with flanged wheels for traveling on rails, such as a Hy-Rail equipped vehicle (trademark of Harsco Technologies LLC). The position coordinate system may include an inertial measurement unit (IMU), a GPS receiver including a GPS antenna, and a wheel encoder. The IMU generally includes accelerometers and gyroscopes which detect accelerations along and rotations about specific axes and convey data representing such accelerations and rotations to the survey computer system which then determines position coordinates of the current location and orientation relative to a previous reference location. The GPS receiver continually determines position coordinates of the GPS antenna and stores the position data in the survey computer. Data from the GPS receiver may be used to regularly establish a new reference location for the IMU. The wheel encoder device determines the distance traveled by the survey vehicle along the railway and stores such position data in the survey computer. Position data from the IMU, the GPS receiver, and the wheel encoder can be compared for accuracy and blended using a Kalman filter. Generally, a Kalman filter operates recursively on streams of noisy input data to produce a statistically optimal estimate of the data set. The IMU is generally treated as the primary data source for position data since the GPS receiver will not always be able to receive signals from the GPS satellites because of terrain or intervening structures. Although the position data obtained from the IMU is relatively precise over short distances, inaccuracies in the data accumulate over longer distances, and the position data from the GPS receiver and the wheel encoder can then be used to correct or reset the position data.

The optical scanning system may be a laser scanning system, also referred to as a LIDAR (light detecting and ranging) device. A LIDAR scanning system operates somewhat like a radar system in that it activates a laser beam and measures the time of reflection back to a sensor and converts the return time to a distance. The return time or distance is recorded along with azimuth and elevation angles of the laser beam, the current position coordinates, and a time stamp. The scene may be scanned in a rectangular raster pattern, that is vertically stacked horizontal lines or horizontally stacked vertical lines or in a radial manner. The result of a complete scan of a given scene is profile data formed by a set of data points representing a coarse three dimensional image of the scene. The data points can be processed using trigonometric operations or other methods to detect only data points in a single vertical plane transverse to the track, with known position coordinates. Data points within the plane representing a survey profile of the ballast at the recorded position coordinates can then be extracted. Systems for scanning railways to obtain ballast profiles are known in the art, such as described in U.S. Pat. No. 6,976,324, referred to above. In an embodiment of the invention, LIDAR scanner units are mounted on the survey vehicle in spaced apart relation. Data points from the scanner units can be processed by software to "stitch" common data points together to form the coarse three dimensional image from which the vertical plane and ballast survey profile can be derived.

As the survey vehicle is being moved along the track, photographic images are also being recorded along with position coordinates. The photographic imaging can be conventional digital video frames which can later be displayed in motion to analyze an area of the railway or which can be slowed or stopped for more detailed analysis. In addition to the recording of conventional video images, an embodiment of the invention also records digital panoramic images along with position coordinates at intervals along the railway. The panoramic images may be quasi-spherical panoramic images similar to the types of images displayed in Street View on Google Maps (trademarks of Google, Inc. maps.google.com) which are formatted for viewing using an internet browser. The viewer can pan the spherical image around a full 360° and tilt up and down for an extensive view of scene. Camera systems for recording such spherical panoramic images are commercially available and are similar to that described in U.S. Pat. No. 5,703,604, which is incorporated herein by reference.

An operator of the survey crew uses a logging terminal, such as another computer or computer device interfaced to survey computer system, to mark end points of areas of the railway on which ballast is not to be spread, such as street crossings, switch points, and other locations. The end points of the no-spread zones are recorded by logging the position coordinates of the survey vehicle at the time the end points are marked and may include time stamps.

When the survey is complete, the collected data may be processed to refine the position coordinates to enhance the accuracy of the survey. Afterward, the optical scan data is processed to determine the area differences between standard ballast templates and the surveyed ballast profiles. Typically, the ballast profiles are divided into sections representing the area between the rails and left and right shoulder. These sections correspond with inner ballast doors and left and right ballast doors on the ballast hopper cars of the ballast train which will be used for a ballast spreading run. The ballast templates may vary according to particular conditions of the track being surveyed. For example, curved sections of track may be given a different ballast profile than a straight section. Adjacent parallel tracks may be given ballast profiles different from that of a single track. The software used for processing the optical scan data preferably has the capability of enabling an analyst to enter characteristics of particular sections of track so that the correct ballast template is used during processing.

The area differences may be averaged along a unit length of the track and multiplied by the unit length to derive ballast replacement volumes. The ballast replacement volumes can be converted to ballast replacement unit weights which correspond to geographically specific units of the railway. For example, the unit length may be a hundredth of a mile, and the unit weight may be expressed in units of tons of ballast per hundredth of a mile. The unit weights may be formatted into a ballast replacement data file for a ballast spreading run including left, center, and right unit weights along with position data for each unit length of the railway section. The position data may mark the beginning of a unit length. The ballast replacement data file also includes data representing ends of ballast no-spread zones. The no-spread data may simply be unit weights with a value of zero.

Before the ballast replacement data file is entered into a ballast train head end controller, the data is processed or reviewed, or both, for anomalies in the unit weights. For example, the ballast replacement weight units can be compared by a computer to a set tonnage. Data indicating application of ballast at too high a rate or at a maximum rate for too long a length of the railway section may indicate an anomaly in the shape of the substructure of the railway, such as the presence of a culvert or ditch. When anomalies are detected or discovered, the photographic images for corresponding sections of the railway section may be accessed and reviewed to determine if adjustments in the unit weights may be necessary. Access to the ballast replacement weight units is provided for such adjustment.

Once all necessary adjustments to the unit weights have been made, the adjusted ballast replacement data file can be entered into the head end controller of the ballast train for communication to ballast car control units or computers to control ballast door actuators during the ballast spreading run to spread at rates to achieve the calculated ballast replacement amounts along geographically specific unit lengths of the railway section. The manner of controlling the ballast train can be similar to that described in U.S. Pat. No. 6,526,339, referred to above.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE PREFERRED EMBODIMENTS

Figure 1:
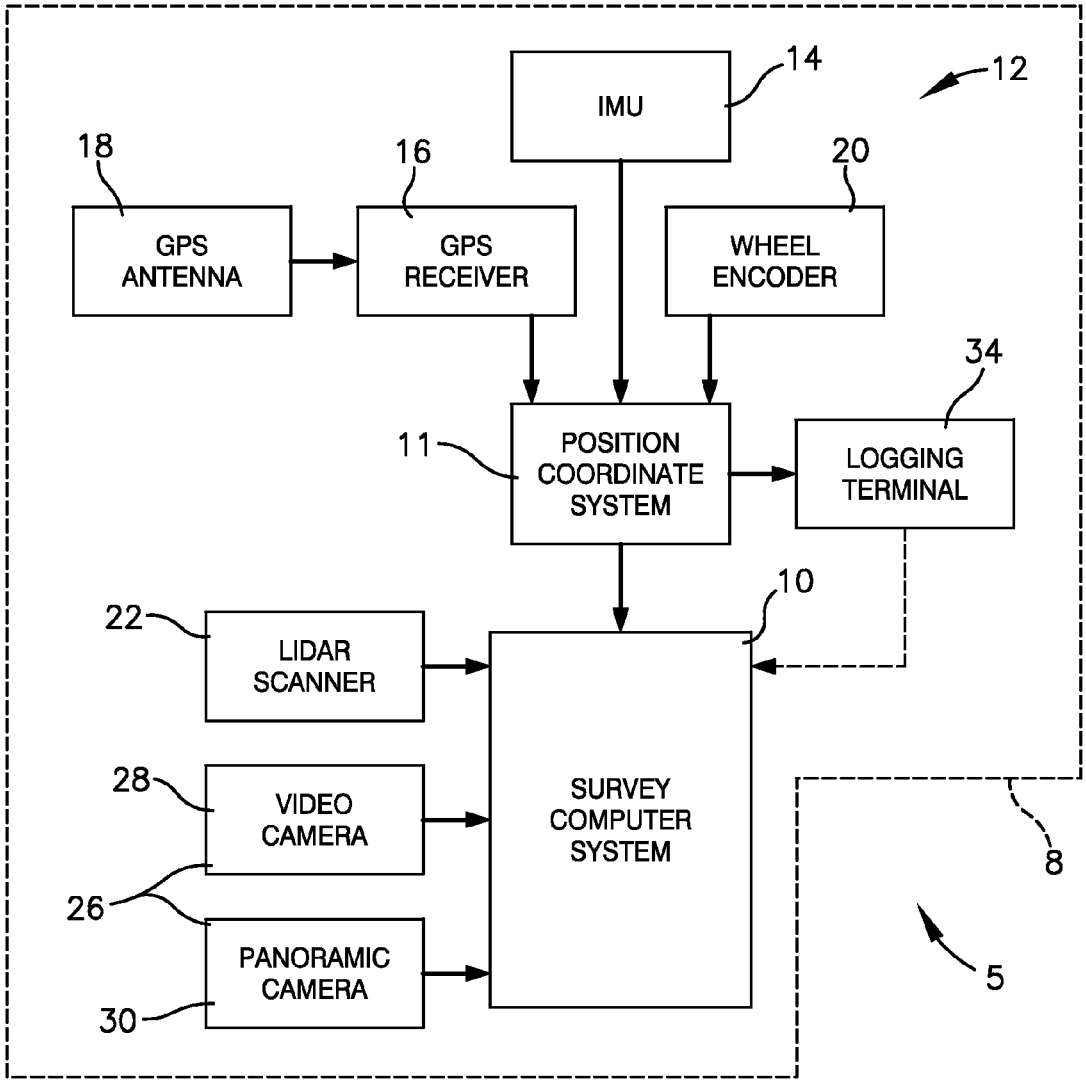
FIG. 1 is a block diagram showing principal components of an embodiment of a survey vehicle computer system for use in the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure Referring to the drawings in more detail, the reference number 1 (FIG. 3) generally designates an embodiment of an automated track surveying and ballast replacement method according to the present invention. In general, the method 1 includes automatically surveying a section of a railway to automatically measure and store ballast survey data representing the condition of ballast along the railway section, obtain photographic images, and log position coordinates along the railway section, detecting or discovering anomalies in replacement ballast unit weights derived from the ballast survey data, reviewing images corresponding geographically with the anomalies, adjusting the ballast unit weights as necessary, and entering the adjusted ballast unit weight data into a computer on a ballast train which controls distribution of ballast therefrom.

Referring to FIG. 1, a ballast survey vehicle 8 is equipped with ballast survey apparatus 5. The illustrated survey apparatus 5 includes a survey computer and data storage system 10 which may include one or more computers and may be referred to as the survey computer system 10. The survey apparatus 5 includes a position coordinate system or controller 11 having one or more position coordinate determining devices 12 interfaced thereto. The position coordinate system 11 may be a separate computer or computer board or may be partially integrated with the position coordinate devices 12. The position coordinate system 11 aggregates position data from the devices 12 and feeds the data into the survey computer system 10. It is foreseen that functions of the position coordinate system 11 may be implemented as one or more applications running on the survey computer system 10.

In the embodiment shown, the position coordinate determining devices 12 include an inertial measurement unit (IMU) 14 which is an instrument with sets of accelerometers and gyroscopes (not shown) which determine accelerations along and rotations about sets of axes and stores data representing such accelerations and rotations in the survey computer system 10. The computer 10 uses data from the IMU 14 to determine a change in position and orientation relative to a reference position. The position coordinate determining devices 12 further include a GPS receiver 16 having a GPS antenna 18 which determines position coordinates of the GPS antenna 18 by processing signals received from GPS satellites. The position data from the GPS receiver 16 can be used to periodically establish a new reference position for the IMU 14. The position coordinate determining devices 12 may also include a wheel encoder 20 engaged with a wheel of the survey vehicle 8 to log linear travel of the vehicle. The IMU 14 acts as the primary position coordinate device 12, since obstructions from the local terrain, structures, or trees will occasionally prevent the GPS receiver 16 from locking onto sufficiently reliable GPS signals. The position coordinate devices 12 are interfaced to the survey computer system 10 and provide their position coordinate data thereto at regular intervals. The position coordinate data may be blended using a Kalman filter (not shown) or by other processes known in the art to optimize the data.

The ballast survey apparatus 5 includes an optical scanning device, such as a LIDAR scanner device 22. The illustrated LIDAR scanner 22 scans scenes of the railway section at regular intervals by scanning a laser beam across or about the track scene in a rectangular or radial pattern, periodically activating the beam and measuring the time of arrival of a reflection from the beam, converting the reflection time to a distance, and storing distance data for each beam activation along with azimuth and elevation angles, current position coordinates, and a time stamp in an optical survey data file within the survey computer system 10. In an embodiment of the ballast survey apparatus 5, a pair of horizontally separated LIDAR scanner devices 22 are mounted on the survey vehicle 8 and perform independent scans of scenes of the railway section. The scanner devices 22 may be mounted so that one scanner scans from the left side of the track outward past the right side of the track and the other scanner scans from the right side of the track outward past the left side of the track. The scanned data can generally be stitched together to create an image including data from both sides of the track and therebetween.

The ballast survey apparatus 5 includes image recording devices 26 which record images of scenes of the railway section at intervals therealong concurrent with the optical scanning by the LIDAR scanner device or devices 22. The disclosed image recording devices 26 include a digital video camera 28 and a digital panoramic camera 30. The digital video camera 28 records conventional digital video data, including digital motion picture frames as the survey vehicle 8 is moved along the railway section. The digital picture frames are associated with position coordinate data provided by the position coordinate devices 12. The digital video data is stored in the survey computer system 10 and can subsequently be replayed at the recorded rate or at slowed rates or stopped frames for detailed analysis of the environment of a particular location along the railway section. The digital panoramic camera 30 records data representing 360° quasi-spherical panoramic images of scenes of the railway section at regular intervals therealong which are associated with position coordinate data provided by the position coordinate devices 12. The digital panoramic image data is stored in the survey computer system 10 and can subsequently be viewed with internet browser type software to display 360° panoramic views of particular locations along the surveyed railway section.

The ballast survey apparatus 5 includes logging terminal 34 which is interfaced to the position coordinate system 11, from which it receives position data. A survey operator riding in the survey vehicle 8 uses the logging terminal to enter or select end points of no-spread zones on which ballast is not to be applied. The end points are defined by position coordinates current at the time of entry, as supplied by the position coordinate system 11. Such no-spread zones may include street crossings of the railway, railroad switch points, and the like. The logging terminal 34 may be interfaced to the survey computer system 10 to provide the no-spread end point data directly to the system 10. Alternatively, such end point data can be retrieved from the logging terminal 34 in post-processing. Under some circumstances, it might be desirable to make estimates of the amount of ballast to be replaced along the railway during a survey run. The logging terminal 34 can be used for entering such estimates.

Figure 2:
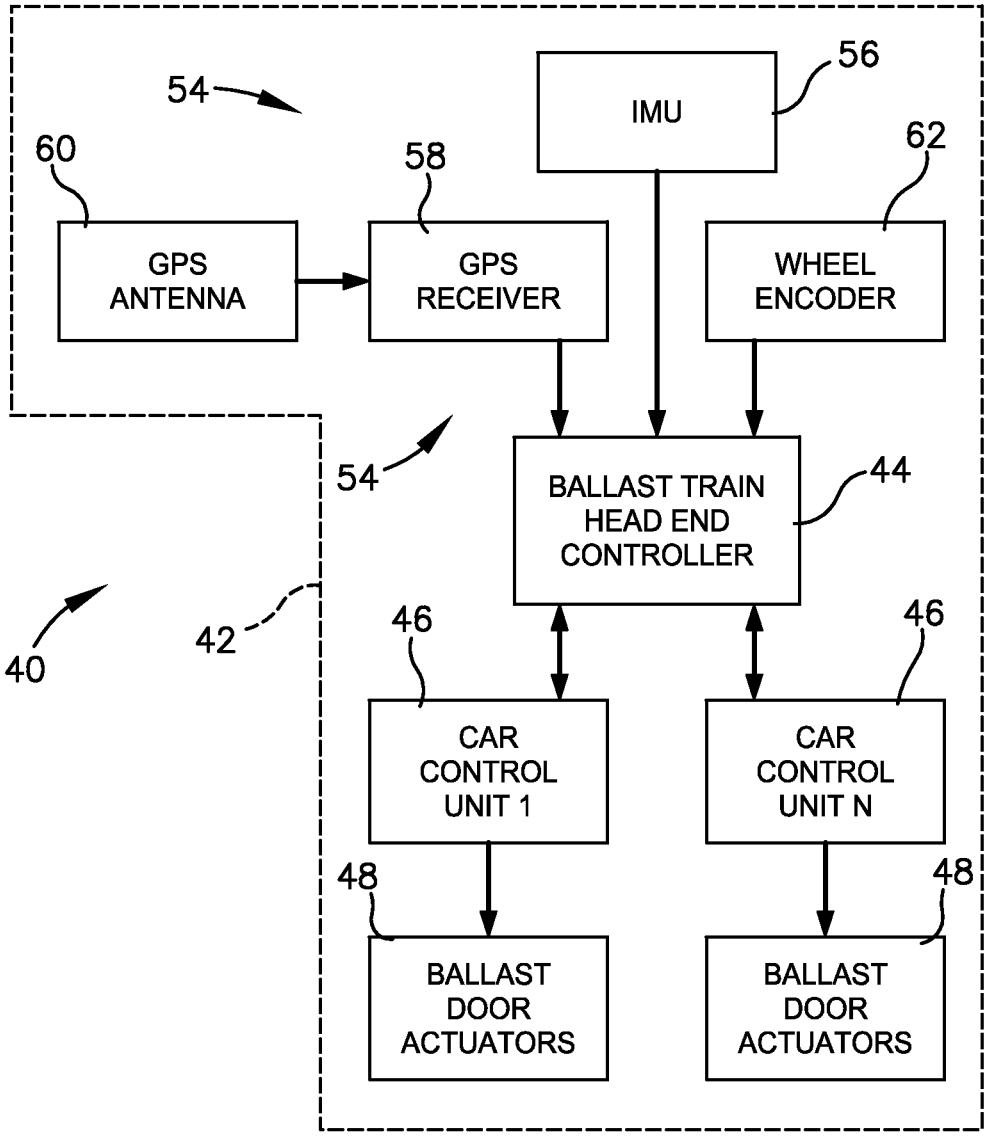
FIG. 2 is a block diagram showing principal components of an embodiment of a ballast train computer system for use in the present invention.

Ballast replacement data and corresponding position coordinates will be used to control the operation of a ballast replacement apparatus 40 (FIG. 2), including hopper cars 41 (FIG. 6) of a ballast train 42. The ballast train 42 has a ballast train head end controller or computer 44 which communicates over a network with a plurality of car control units or computers 46 which control ballast door actuators 48 which, in turn, open and close ballast doors 50 of the ballast hoppers of the hopper cars 41, as will be described further below. Position coordinate devices 54 are interfaced to the head end controller 44 and provide position coordinates of the ballast train 42 thereto. The position coordinate devices 54 may include an inertial measurement unit (IMU) 56, a GPS receiver 58 with a GPS antenna 60, and a wheel encoder 62. The ballast replacement apparatus 40 may be operated in a manner similar to that described in U.S. Pat. Nos. 6,526,339 and 7,152,347, which were referenced above.

Figure 3:
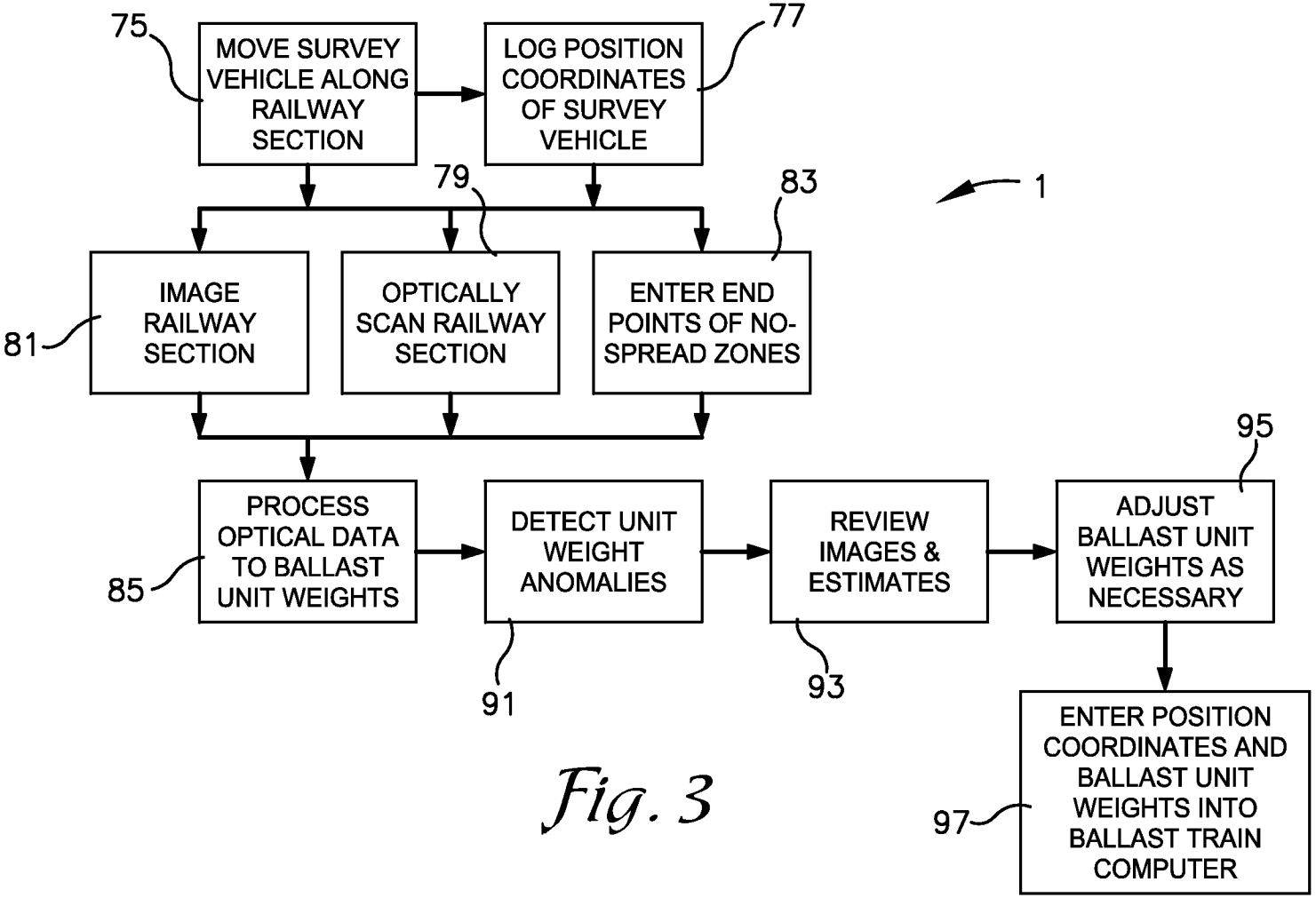
FIG. 3 is a flow diagram of principle steps in an embodiment of an automated track surveying and ballast replacement method according to the present invention.

Referring to FIG. 3, in an embodiment of the automated track surveying and ballast replacement method 1, the survey vehicle 8 is moved along a section of a railway at step 75 while position coordinates are logged into the survey computer system 10 at step 77, using the IMU 14, the GPS receiver 16, and the wheel encoder 20. As the survey vehicle 8 is moved along the railway section, scenes of the railway section are optically scanned at regular intervals at step 79 by the LIDAR scanner device 22, and profile data, formed by optical data points, is stored in an optical data file in the survey computer system 10 along with current position coordinates. As the optical scanning 79 is occurring, digital photographic images are recorded at step 81 by the video camera 28 and the panoramic camera 30 and stored in the survey computer system 10 along with position coordinates. At appropriate locations along the railway, the ends of ballast no-spread zones are manually entered into the computer system 10 along with position coordinates, at step 83, by an operator using the logging terminal 34.

When a ballast survey run has been completed, the profile data in the optical data file is processed at step 85 to derive ballast unit weights corresponding geographically to unit lengths of the railway section which are stored in a ballast replacement data file. The optical data file may also be processed to refine the accuracy of the position coordinate data. The processing step 85 includes deriving ballast survey profiles 87 (FIG. 4) at intervals along the railway section. A survey profile 87 represents the shape of the ballast at a vertical plane transverse to the track at a particular logged position along the railway section. The survey profile 87 is formed from a plurality of LIDAR data points extending across a vertical plane perpendicular to a centerline of the track bed. The survey profile 87 is compared to a standard ballast template 89, which represents the desired shape of the ballast at the corresponding location. The shape of a ballast template 89 may vary depending on the local circumstances associated with a particular portion of the railway, such as the presence of another track, curvature of the railway, or the like. The comparison process involves subtracting the area under each ballast survey profile 87 from the area under a ballast template 89 to determine an area difference. The area difference can be averaged along a unit length of the railway section and used to determine a ballast replacement volume which can then be converted to a ballast replacement unit weight for the corresponding unit length of the railway section.

The ballast replacement data file may be processed at step 91 to detect anomalies in the unit weights and/or it may be reviewed by an analyst to discover such anomalies. Anomalies in the unit weights are values which are different from expected ranges. If anomalous unit weights are detected or discovered, access is provided to images corresponding geographically to the anomalous unit weights at step 93 to enable review of such images to determine the environment of the railway in the vicinity of the railway unit length. The images reviewed are the images recorded at step 81. Access is provided to the anomalous unit weight values at step 95 to enable adjustment of the anomalous unit weights to more appropriate values, as determined by the images reviewed at step 93. When all the required adjustments have been made, the ballast replacement data file, including ballast unit weights and corresponding position coordinates, is ready for entering into the ballast train head end controller 44 at step 97. The unit weight and position coordinate data in the ballast replacement data file is used by the head end controller 44 to control the ballast door actuators 48 to open and close to apply the need amounts of ballast to the railway section and to avoid spreading ballast along no-spread zones during a ballast replacement run of the ballast replacement train 42.

Figures 4, 5:
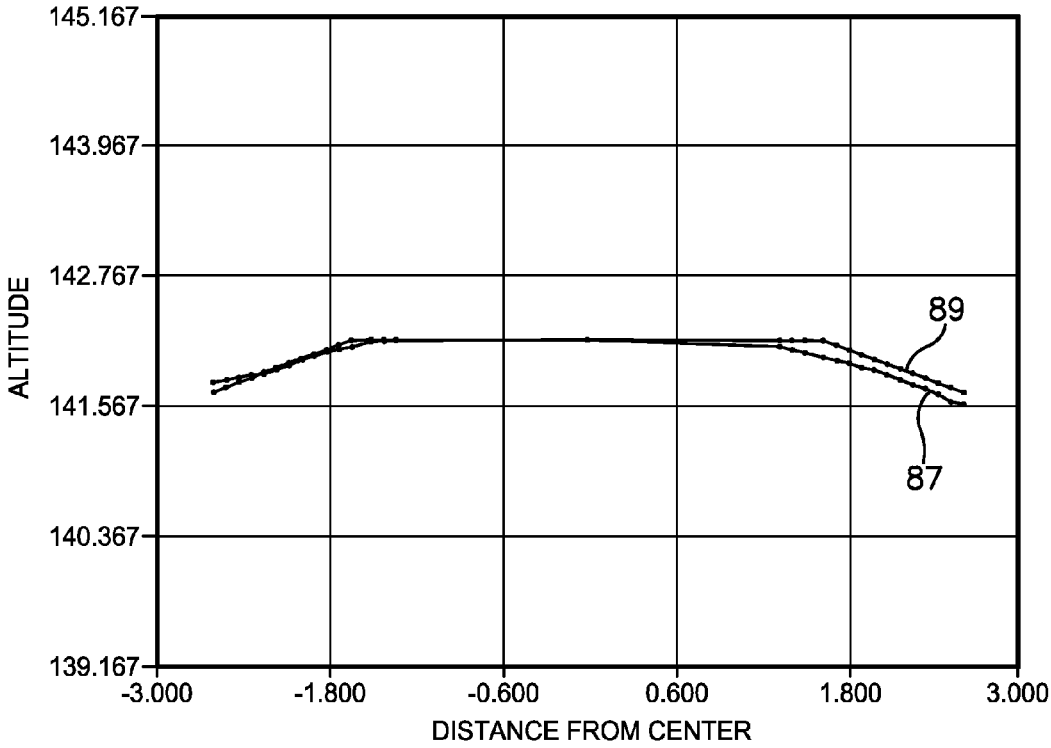
FIG. 4 is a graph illustrating a surveyed ballast profile superimposed on a template ballast profile for determining an incremental ballast unit weight according to the present invention.
FIG. 5 is a segment of an excessive tonnage table of anomalous ballast replacement weight units exceeding a selected tonnage limit, along with geographic coordinates associated with the anomalous weight units.

FIG. 5 illustrates a segment of an excessive tonnage table 100 which may be generated by step 91 of the process 1. Step 91 detects any ballast replacement unit weights which exceed a selected value. In an embodiment of the process 1, the limit unit weight is 500 tons. In the illustrated table 100, an index column 102 of the table 100 shows an index number associated with a relative location of a ballast survey run along the railway. A side column 104 indicates whether the excessive tonnage was derived from the left or right side of the railway. It is foreseen that a center position could alternatively be recorded. A tonnage column 106 includes tonnage values derived from the locations indicated by the index number. Latitude and longitude columns 108 and 110 provide position coordinates of the location with which the excessive tonnage is associated. The illustrated latitude and longitude values are exemplary. Finally, an altitude column 112 shows the altitude of the location of the excessive tonnage. A value of each row of the table 100, such as the index number may be encoded as a hyperlink which may be selected to access images associated with the location for review to determine the reason for the excessive tonnage or anomalous unit weight determination. The data sets of excessive tonnage table 100 may be extracted from a much larger table which includes data sets associated with each of the intervals along the section of railway which has been surveyed by the process 1.

Figure 6:
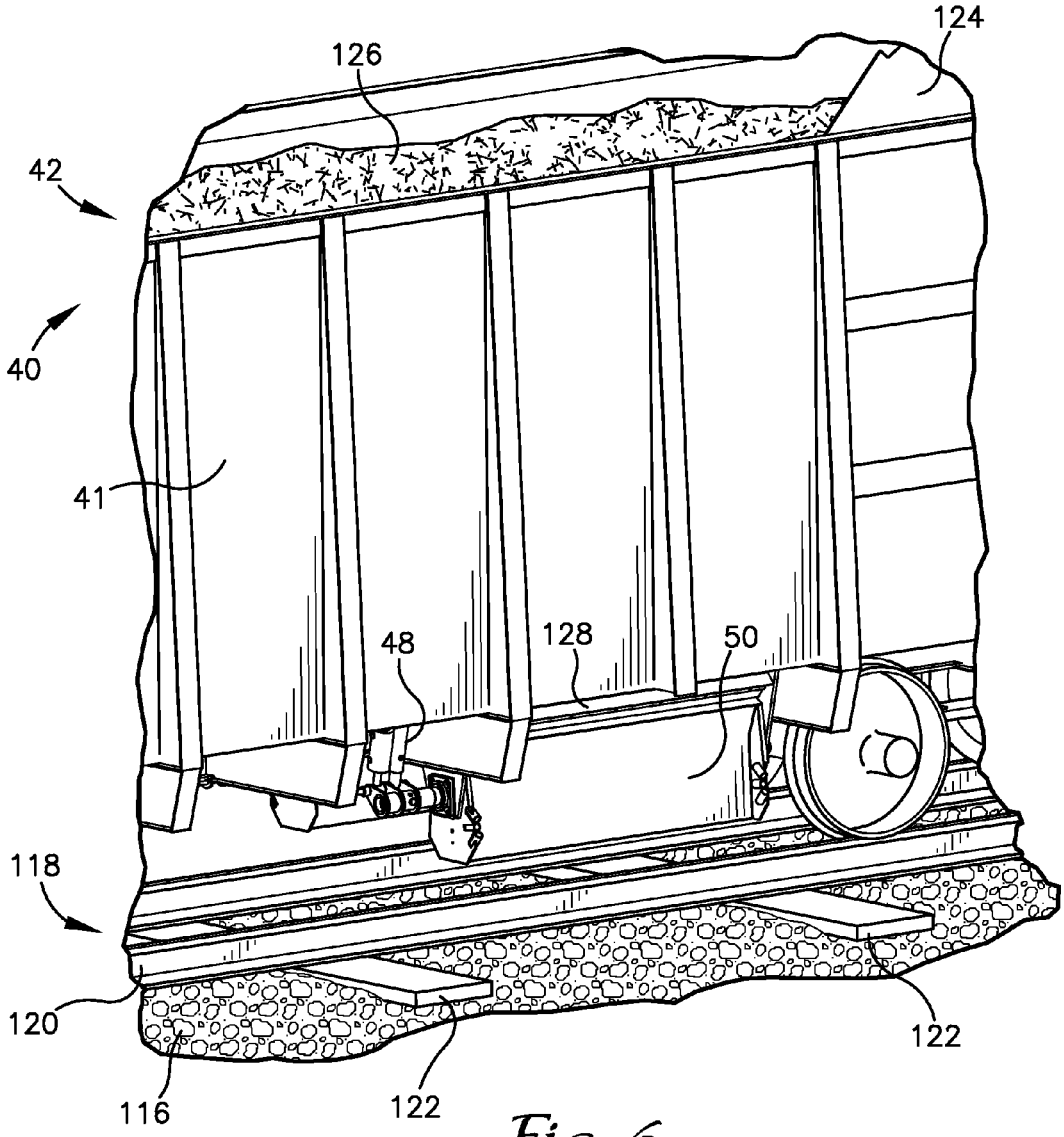
FIG. 6 is a fragmentary perspective view of an exemplary ballast replacement car for use in the present invention.

FIG. 6 illustrates an embodiment of a ballast replacement apparatus 40 which will be controlled by data derived from the process 1 to augment existing ballast 116 forming a component of a railway or track 118. The track 118 includes rails 120 mounted on cross ties 122 which are stabilized by the ballast 116. The illustrated ballast replacement apparatus 40 is a ballast hopper car 41 having front and rear ballast hoppers 124 loaded with replacement ballast 126. The hoppers 124 converge to ballast chutes 128 which feed the ballast 126 by gravity, as controlled by ballast control gates or doors 50. The ballast door actuators 48 are engaged between the doors 50 and the structure of the hopper car 41 and may be activated to open the door 50 outward or inward toward the center of the track 118, depending on the configuration of the door 50 provided. The illustrated actuators 48 are hydraulic; however, it is foreseen that other types of motor mechanisms could be employed. The door actuators 48 are preferably relatively fast acting to enable accurate startup and shutdown of ballast feed from the chutes 128 between ballast spread zones and no-spread zones. The ballast train 42 may include a large number of the hopper cars 41 to quickly and efficiently maintain ballast 116 along a selected section of the railway 118. It is foreseen that other types of ballast replacement equipment could be employed in practice of the process 1.

It is to be understood that while certain forms of the present invention have been illustrated and described herein, it is not to be limited to the specific forms or arrangement of parts described and shown.

What is claimed as new and desired to be secured by Letters Patent is:

1. A method for automated track surveying and ballast replacement and comprising the steps of:

(a) moving a survey vehicle along a section of a railway;

(b) obtaining survey vehicle position coordinates of said survey vehicle at intervals spaced along said section of railway using a survey vehicle position coordinate system and storing said position coordinates in a survey computer system;

(c) concurrently:

(1) scanning said railway to obtain position referenced track profile data points at each of said intervals and storing said track profile data points in said survey computer system;

(2) recording image data of said railway at each of said intervals using an image recording device and storing said image data in said survey computer system; and (3) entering end locations of ballast no-spread zones along the railway section into said survey computer system;

(d) processing said track profile data points to obtain a ballast replacement data file including ballast replacement unit weights per selected unit of length of said railway section, each ballast replacement unit weight being positionally associated with a corresponding unit of said railway section;

(e) processing said ballast replacement unit weights to detect anomalous unit weights among said ballast replacement unit weights of said data file which exceed a selected unit weight;

(f) displaying image data corresponding with any unit of said railway section associated with an anomalous unit weight to enable review of such image data;

(g) providing access to said anomalous unit weights of said data file to enable adjustment thereof to appropriate levels in response to reviewing image data associated therewith; and (h) loading said survey vehicle position coordinates and data representing said unit weights, including adjusted unit weights, into a ballast distribution computer controlling distribution of ballast from ballast distribution cars of a ballast train to thereby distribute said unit weights of ballast to corresponding units of length of said railway section.

2. A method as set forth in claim 1 wherein said step of recording image data includes the step of:

(a) recording panoramic image data of said railway at each of said intervals in said survey computer system.

3. A method as set forth in claim 1 and including the step of:

(a) obtaining said survey vehicle position coordinates using a global positioning system receiver.

4. A method as set forth in claim 1 and including the step of:

(a) obtaining said survey vehicle position coordinates using an inertial measurement unit.

5. A method as set forth in claim 1 and including the step of:

(a) obtaining said survey vehicle position coordinates using a wheel encoder of said survey vehicle.

6. A method as set forth in claim 1 and including the step of:

(a) obtaining said track profile data points by optically scanning said railway using a laser scanning device.

7. A method for automated track surveying and ballast replacement and comprising the steps of:

(a) moving a survey vehicle along a section of a railway;

(b) obtaining survey vehicle position coordinates of said survey vehicle at intervals spaced along said section of railway using a survey vehicle position coordinate system and storing said position coordinates in a survey computer system;

(c) concurrently:

(1) optically scanning said railway with an optical scanning device to obtain position referenced optical track profile data points at each of said intervals and storing said track profile data points in said survey computer system;

(2) recording image data of said railway at each of said intervals using an image recording device and storing said image data in said survey computer system; and (3) entering end locations of ballast no-spread zones into said survey computer system;

(d) processing said optical track profile data points to obtain a ballast replacement data file including ballast replacement unit weights per selected unit of length of said railway section, each ballast replacement unit weight being positionally associated with a corresponding unit of said railway section;

(e) processing said ballast replacement unit weights to detect anomalous unit weights among said ballast replacement unit weights of said data file which exceed a selected unit weight;

(f) displaying image data corresponding with any unit of said railway section associated with an anomalous unit weight to enable review of such image data;

(g) providing access to said anomalous unit weights of said data file to enable adjustment thereof to appropriate levels in response to reviewing image data associated therewith; and (h) loading said survey vehicle position coordinates and data representing said unit weights, including adjusted unit weights, into a ballast distribution computer controlling distribution of ballast from ballast distribution cars of a ballast train to thereby distribute said unit weights of ballast to corresponding units of length of said railway section.

8. A method as set forth in claim 7 and including the steps of:

(a) processing said track profile data points to obtain ballast profile data representing a transverse cross sectional survey profile of a ballast bed of said railway at each of said intervals;

(b) processing said ballast profile data of each interval to compare said ballast profile data with template data representing a standard ballast bed template profile;

(c) processing said ballast profile data and said template data to calculate a difference area between each survey profile and said template profile;

(d) processing the difference areas to sum the difference areas of all intervals within each of a plurality of units of said section of railway to obtain a plurality of unit volumes of ballast to be replaced in said units; and (e) processing said unit volumes to convert said unit volumes to said ballast replacement unit weights.

9. A method as set forth in claim 7 wherein said step of recording image data includes the step of:

(a) recording panoramic image data of said railway at each of said intervals in said survey computer system.

10. A method as set forth in claim 7 and including the step of: (a) obtaining said track profile data points by optically scanning said railway using a laser scanning device.

11. A method as set forth in claim 7 and including the step of:

(a) obtaining said survey vehicle position coordinates using a global positioning system receiver.

12. A method as set forth in claim 7 and including the step of:

(a) obtaining said survey vehicle position coordinates using an inertial measurement unit.

13. A method as set forth in claim 7 and including the step of:

(a) obtaining said survey vehicle position coordinates using a wheel encoder of said survey vehicle.

14. A method as set forth in claim 7 and including the step of:

(a) obtaining ballast train position coordinates of said ballast train using a global positioning system receiver.

15. A method for automated track surveying and ballast replacement and comprising the steps of:

(a) moving a survey vehicle along a section of a railway;

(b) obtaining survey vehicle position coordinates of said survey vehicle at intervals spaced along the railway section using a survey vehicle position coordinate system and storing said position coordinates in a survey computer system;

(c) optically scanning said railway at each of said intervals with an optical scanning device to obtain track profile data points and storing said track profile data points in said survey computer system, each of said track profile data points having position coordinates referenced thereto;

(d) recording image data of said railway at each of said intervals using an image recording device and storing said image data in said survey computer system, each image having position coordinates associated therewith;

(e) entering no-spread data marking a beginning or end positions of areas of said railway section on which ballast will not be spread into said survey computer system, said no-spread data having position coordinates associated therewith;

(f) processing said track profile data points to obtain a ballast replacement data file including ballast survey profiles of each of said intervals and to compare said survey profiles with standard ballast bed template profiles to determine area differences therebetween, and to convert said area differences to ballast replacement unit weights per selected unit of length of said railway section, each ballast replacement unit weight being positionally associated with a corresponding unit of said railway section;

(g) processing said ballast replacement unit weights to detect anomalous unit weights among said ballast replacement unit weights of said data file which exceed a selected unit weight;

(h) displaying image data corresponding with any unit of said railway section associated with an anomalous unit weight to enable review of such image data;

(i) providing access to said anomalous unit weights of said data file to enable adjustment of selected ones of said anomalous unit weights to appropriate levels in response to reviewing image data associated therewith; and (j) loading said survey vehicle position coordinates and data representing said unit weights, including adjusted unit weights, into a ballast distribution computer controlling distribution of ballast from ballast distribution cars of a ballast train to thereby distribute said unit weights of ballast to corresponding units of length of said railway section.

16. A method as set forth in claim 15 wherein said step of recording image data includes the step of:

(a) recording panoramic image data of said railway at each of said intervals in said survey computer system.

17. A method as set forth in claim 15 and including the step of:

(a) obtaining said survey vehicle position coordinates using a global positioning system receiver.

18. A method as set forth in claim 15 and including the step of:

(a) obtaining said survey vehicle position coordinates using an inertial measurement unit.

19. A method as set forth in claim 15 and including the step of:

(a) obtaining said survey vehicle position coordinates using a wheel encoder of said survey vehicle.

20. A method as set forth in claim 15 and including the step of:

(a) obtaining said track profile data points by optically scanning said railway using a laser scanning device.

* * * * *